US007019287B2

(12) United States Patent
Heo

(10) Patent No.: US 7,019,287 B2
(45) Date of Patent: Mar. 28, 2006

(54) SAMPLE HOLDER FOR LASER DESORPTION/IONIZATION MASS SPECTROMETRY AND METHOD OF MANUFACTURING THE SAME

(75) Inventor: Soo-bong Heo, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/823,698

(22) Filed: Apr. 14, 2004

(65) Prior Publication Data

US 2004/0245456 A1 Dec. 9, 2004

(30) Foreign Application Priority Data

Jun. 7, 2003 (KR) ..... 10-2003-0036604

(51) Int. Cl.
*H01J 49/04* (2006.01)

(52) U.S. Cl. ..... 250/288

(58) Field of Classification Search ..... 250/288
See application file for complete search history.

(56) References Cited

U.S. PATENT DOCUMENTS

2002/0187312 A1 12/2002 Fonash et al.
2003/0010908 A1* 1/2003 Clark et al. ..... 250/288
2004/0094705 A1* 5/2004 Wood et al. ..... 250/288

OTHER PUBLICATIONS

Sunner et al., "Graphite Surface-Assisted Laser Desorption/Ionization Time-of-Flight Mass Spectrometry of Peptides and Proteins from Liquid Solutions", *Analytical Chemistry*, Dec. 1, 1995, vol. 67, No. 23.

Hie-Joon Kim et al., "Observation of Low Molecular weight Poly(methylsilsesquioxane)s by Graphite Plate Laser Desorption/Ionization Time-of Flight Mass Spectrometry", Analytical Chemistry, 2000, pp. 5673-5678, vol. 72, No. 22, American Chemical Society, Published on Web Oct. 10, 2000.

* cited by examiner

*Primary Examiner*—Jack I. Berman
(74) *Attorney, Agent, or Firm*—Buchanan Ingersoll PC

(57) ABSTRACT

Provided are a sample holder for laser desorption/ionization mass spectrometry and a method of manufacturing the sample holder. The sample holder includes a metal plate and a thin layer, which is formed on the metal plate and onto which a sample to be analyzed is loaded. The thin layer is formed of a carbon-based material, such as carbon or graphite. The thin layer is deposited on the metal plate by arc-discharging carbon rods and sputtering carbon atoms emitted from the carbon rods onto the metal plate or by coating the metal plate with a carbon or graphite paste, which is a mixture of carbon or graphite powder and a volatile solvent. Accordingly, it is possible to rule out any possibilities of a matrix or silicon oil having undesirable influences on a mass spectrum of the sample, easily and precisely measure not only a polymer but also a low molecular weight material with a molecular weight of 500 Da or lower, and precisely analyze the mass of the polymer without using an ionization additive, such as salt.

16 Claims, 7 Drawing Sheets

SAMPLE HOLDER FOR LASER DESORPTION/IONIZATION MASS SPECTROMETRY AND METHOD OF MANUFACTURING THE SAME

BACKGROUND OF THE INVENTION

This application claims the priority of Korean Patent Application No. 2003-36604, filed on Jun. 7, 2003, in the Korean Intellectual Property Office, the disclosure of which is incorporated herein in its entirety by reference.

1. Field of the Invention

The present invention relates to laser desorption/ionization mass spectrometry, and more particularly, to a sample holder for laser desorption/ionization mass spectrometry, which can easily and precisely analyze low molecular weight materials as well as high molecular weight materials.

2. Description of the Related Art

Matrix-assisted laser desorption/ionization (MALDI) mass spectrometry has been widely used for analyzing high molecular weight materials, for example, living body substances (such as protein) or polymers. MALDI mass spectrometry is a type of mass spectrometry, in which a sample loaded into a sample holder is desorbed and ionized by applying ultra violet rays or infrared laser beams thereto and the mass of the sample is analyzed by measuring the time of flight (TOF) of ions of the sample.

FIG. 1A is a diagram illustrating a conventional matrix-assisted laser desorption/ionization (MALDI) mass spectrometer, and FIG. 1B is an enlarged view of a portion A of FIG. 1A.

Referring to FIGS. 1A and 1B, in the conventional MALDI mass spectrometer, a metal plate 10, which is generally formed of stainless steel or gold-coated steel, is used as a sample holder for loading a sample 21. A surface of the metal plate 10 is coated with a material layer 20, which is a mixture of the sample 21 and a matrix 22. The metal plate 10 coated with the sample 21 is placed on a supporting means 31 in a vacuum chamber (not shown).

When ultra violet rays or infrared laser beams are applied to the sample 21 and the matrix 22 loaded on the metal plate 10, the sample 21 is desorbed from the metal plate 10 together with the matrix 22 and then ionized. Ions of the sample 21 are accelerated by an electric field formed by grids 32 and then travel to a detector 34 passing through a deflector 33. At this moment, the TOF of the ions can be measured by the detector 34, and the mass of the ions can be measured using the TOF of the ions.

In the above-mentioned conventional MALDI mass spectrometry, the matrix 22, which facilitates the desorption and ionization of the sample 21, is generally formed of organic acid that readily absorbs ultra violet rays. The ionization of the sample 21 has not yet been fully disclosed, but it is known that the matrix 22, which takes up most of the material layer 20, absorbs the energy of the laser beams applied to the material layer 20 and then transfers the absorbed energy to the sample 21 to facilitate the ionization of the sample 21 during or after the desorption of the sample 21 from the metal plate 10.

In the conventional MALDI mass spectrometry, the degree to which the sample 21 is desorbed from the metal plate 10 and is ionized varies depending on the types of the matrix 22 and a solvent used to mix the sample 21 with the matrix 22 because solid structures, which are formed of a mixture of the sample 21 and the matrix 22 on the metal plate 10 after the solvent vaporizes, are not uniform over the metal plate 10. Therefore, the mass spectrum varies depending on how the sample 21 has been prepared. In addition, the mass spectrum of the sample 21 varies from position to position of the metal plate 10. Thus, it is very difficult to obtain consistent measurement results. Moreover, the conventional MALDI mass spectrometry may fail to precisely measure the molecular weight of a polymer because the molecular weight of the polymer may vary depending on the type of a matrix or a solvent.

Furthermore, since the matrix 22 is ionized together with the sample, it may be very difficult to measure or analyze the mass of the sample 21 due to an interference of ions of the matrix 22, especially when the molecular weight of the sample 21 is not much different from that of the matrix 22, in other words, when the sample 21 is formed of a material with a low molecular weight of, for example, 500 Da or lower.

FIG. 2A is a diagram illustrating a mass spectrum of a sample with a low molecular weight, which is obtained by using the conventional MALDI mass spectrometer. Referring to FIG. 2A, many peaks represent masses of matrix ions while few peaks represent masses of sample ions. In FIG. 2A, the mass of a sample is expressed by the atomic weight (m/z) with respect to the electric charge of each of the sample ions.

The conventional MALDI mass spectrometry can be very useful for the analysis of water-soluble proteins but can be inappropriate for the analysis of polymers, in which organic solvents are generally used, because polymers do not have protons or salts, which are necessary for ionization of the polymers. Consequently, there is the need to add salt to the polymer samples.

FIG. 2B is a diagram illustrating a mass spectrum of a polymer, which is obtained by using the conventional MALDI mass spectrometer. Referring to FIG. 2B, there are few peaks representing the masses of the ions of the polymer because salt was not added to the polymer.

In the meantime, if a mixture of the matrix 22 and the sample 21 is a strong acid, it may erode the metal plate 10 so that the surface of the metal plate 10 may become rough such that it would be difficult to desorb the matrix 22 and the sample 21 from the metal plate 10.

In order to solve the above-mentioned problems of the conventional MALDI mass spectrometry, research has been vigorously carried out on alternatives to the conventional MALDI mass spectrometry. One of the alternatives is laser desorption/ionization mass spectrometry using a porous silicon plate, which has been disclosed in U.S. Pat. No. 6,288,390.

In the patented laser desorption/ionization mass spectrometry, a porous silicon plate is used as a sample holder, which means that a matrix is unnecessary. Therefore, it is possible to obtain a mass spectrum of a sample without any possibilities of a matrix and a solvent having undesirable influences on the mass spectrum. In addition, since a matrix is not used, it is easy to interpret the mass spectrum of a sample with a low molecular weight of 500 Da or lower.

However, since a polymer does not contain protons or salts, it is impossible to ionize the polymer for analysis thereof without adding a salt, such as silver trifluoroacetate (AgTFA), to the polymer. In addition, it is rather complicated to manufacture the porous silicon plate.

FIG. 3 illustrates a graphite plate, which is introduced by Hee-jun Kim et al., in Anal. Chem. 72, pp. 5673–5678 (2000). Referring to FIG. 3, a sample 70, which is to be analyzed, is loaded onto a graphite plate 60 without using a matrix. In FIG. 3, white spots represent the sample 70 loaded onto the graphite plate 60. When the graphite plate 60 absorbs ultra violet rays or infrared rays, a portion of the graphite plate 60 is desorbed from the graphite plate 60 together with the sample 70 and then ionizes the sample 70. Therefore, in the case of using the graphite plate 60 as a sample holder, like in the case of using a silicon plate as a sample holder, there is no need to use a matrix, and thus, it is possible to obtain a mass spectrum of the sample 70 without worrying about the influence of the matrix on the mass spectrum. In addition, since the graphite plate 60 includes $Na^+$ ions and $K^+$ ions, it is possible to ionize and measure a polymer, i.e., the sample 70, without adding salt to the polymer.

The graphite plate 60 is manufactured by cutting a graphite rod into pieces with a thickness of about 2–3 mm using silicon oil. The silicon oil, which is a silicon-based compound with a low molecular weight of about 300–400 Da, is easily absorbed into the graphite plate 60 such that it would be very difficult to remove the silicon oil from the graphite plate 60. Therefore, in the case of analyzing a mass spectrum of a low molecular weight material with a similar molecular weight material to that of silicon oil, it can be very difficult to precisely measure the mass spectrum of the low molecular weight material due to the interference of the silicon oil.

FIG. 4 illustrates a mass spectrum obtained from the graphite plate 60. Referring to FIG. 6, many peaks caused by the silicon oil are rather concentrated in a mass range of 300 m/z to 400 m/z. Two peaks in the far left of FIG. 2B represent masses of $Na^+$ ions and $K^+$ ions, respectively.

SUMMARY OF THE INVENTION

The present invention provides a sample holder for laser desorption/ionization mass spectrometry and a method of manufacturing the sample holder. The sample holder includes a metal plate coated with a high-purity carbon layer or a graphite layer, so it can easily and precisely analyze a low molecular weight material as well as a high molecular weight material.

According to an aspect of the present invention, there is provided a sample holder for laser desorption/ionization mass spectrometry, which loads a sample to be analyzed using laser desorption/ionization mass spectrometry. The sample holder includes a metal plate, and a thin layer, which is formed on the metal plate and into which the sample is loaded. The thin layer is formed of a carbon-based material.

The thin layer may be formed of carbon.

The thin layer may be formed of graphite.

The thin layer may be formed on the metal layer to have a thickness of several or dozens of micrometers.

The metal plate may be formed of stainless steel or gold-coated steel.

According to another aspect of the present invention, there is provided a method of manufacturing a sample holder for laser desorption/ionization mass spectrometry. The sample holder loads a sample to be analyzed using laser desorption/ionization mass spectrometry. The method involves preparing a metal plate and depositing a carbon layer on the metal plate through sputtering.

The carbon layer may be deposited on the metal plate by arc-discharging a carbon rod and sputtering carbon atoms onto the metal plate.

According to still another aspect of the present invention, there is provided a method of manufacturing a sample holder for laser desorption/ionization mass spectrometry. The sample holder loads a sample to be analyzed using laser desorption/ionization mass spectrometry. The method involves preparing a metal plate, forming a graphite paste by mixing graphite powder and binder with a solvent, then coating a surface of the metal plate with the graphite paste, and forming a graphite layer on the metal plate by drying the graphite paste.

The solvent may be a volatile solvent and vaporizes when drying the carbon paste.

The carbon layer may be formed on the metal plate to have a thickness of several or dozens of micrometers.

As described above, in the present invention, a carbon or graphite layer, which is formed through sputtering or powder coating, is used. Thus, it is possible to prevent a matrix and silicon oil from having an influence on the analysis of a sample. In addition, it is possible to easily and precisely measure and analyze not only a polymer but also a low molecular weight material with a molecular weight of 500 Da or lower. Furthermore, it is possible to measure a mass of a polymer without using an ionization additive, such as salt.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1A:
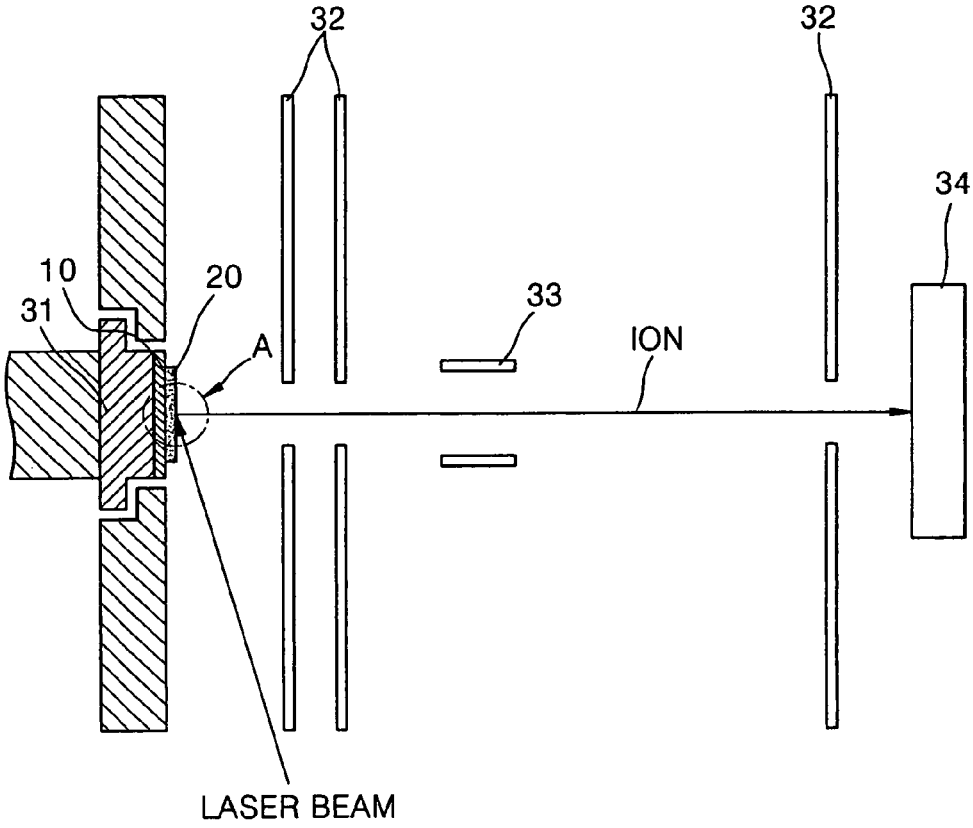
FIG. 1A (PRIOR ART)
FIG. 1A is a diagram illustrating a conventional matrix-assisted laser desorption/ionization (MALDI) mass spectrometer.
Figure 1B:
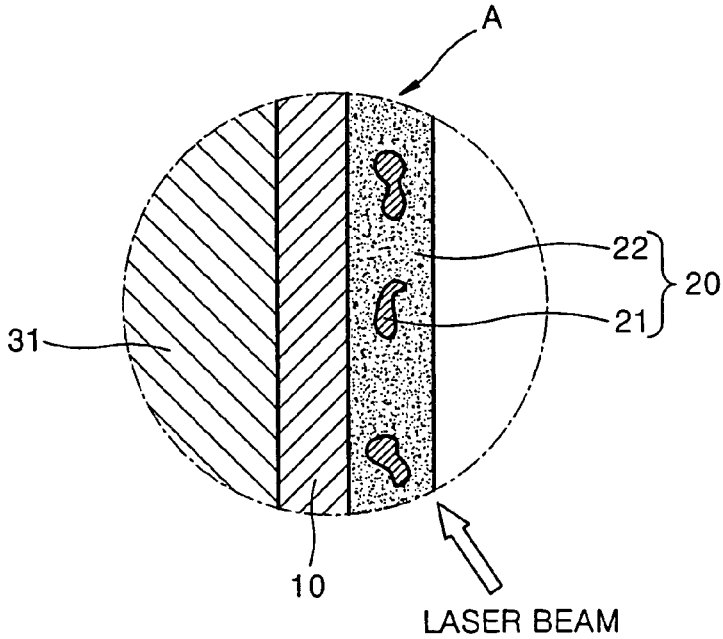
FIG. 1B (PRIOR ART)
FIG. 1B is an enlarged view of a portion A of FIG. 1A.

The present invention will now be described more fully with reference to the accompanying drawings, in which preferred embodiments of the invention are shown. This invention may, however, be embodied in many different forms and should not be construed as being limited to the embodiments set forth herein. Rather, these embodiments are provided so that this disclosure will be thorough and complete, and will fully convey the concept of the invention to those skilled in the art. In the drawings, the thickness of layers and regions are exaggerated for clarity.

Figure 5:
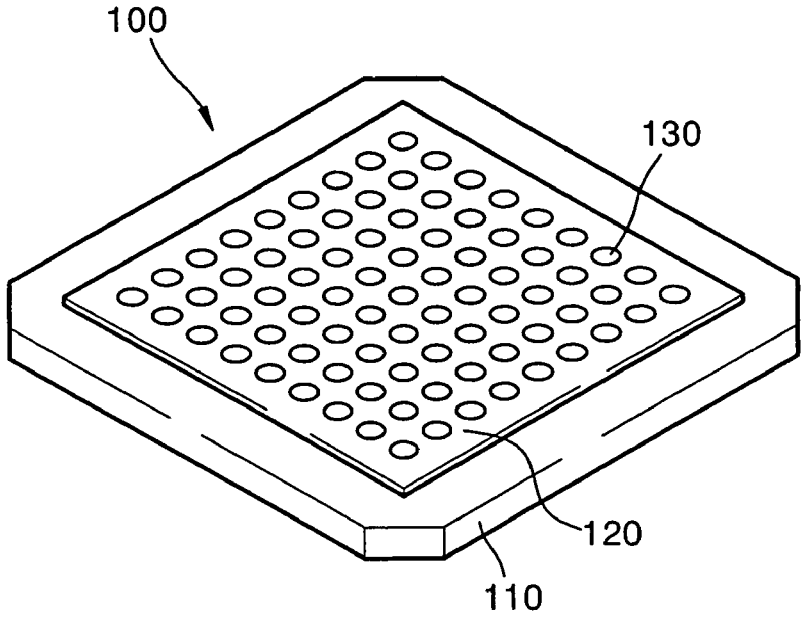
FIG. 5 is a perspective view of a sample holder for laser desorption/ionization mass spectrometry, according to a preferred embodiment of the present invention.
Figure 6:
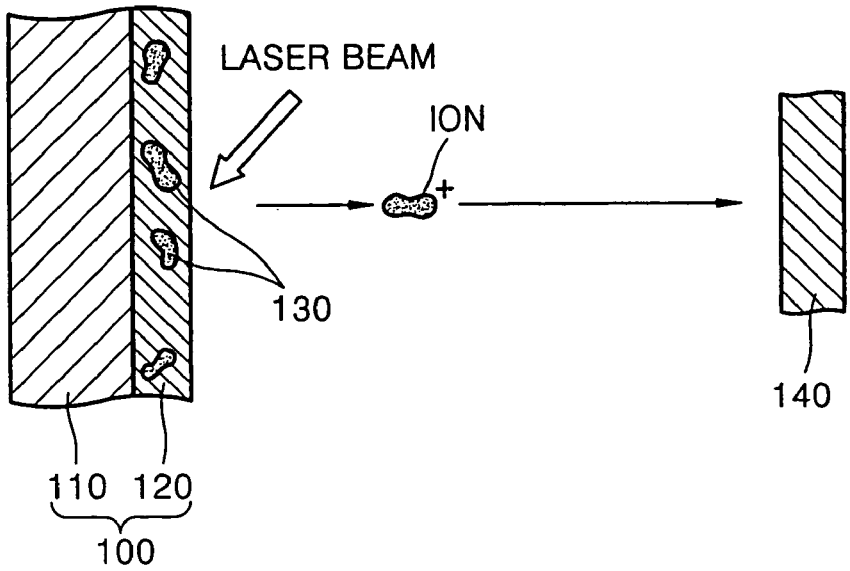
FIG. 6 is a cross-sectional view illustrating part of the sample holder of FIG. 5.

FIG. 5 is a perspective view of a sample holder 100 for laser desorption/ionization mass spectrometry, according to a preferred embodiment of the present invention, and FIG. 6 is a cross-sectional view illustrating part of the sample holder 100 of FIG. 5. Referring to FIGS. 5 and 6, the sample holder 100, which is for loading a sample 130 to be analyzed using laser desorption/ionization mass spectrometry, includes a metal plate 110 and a carbon layer 120 formed on the metal plate 110.

The metal plate 110 is preferably formed of stainless steel or gold-coated steel to have a thickness of, for example, 2–3 mm, so that it cannot be easily deformed.

The carbon layer 120 is thinly formed on the metal plate 110 to have a thickness of several or dozens of micrometers. The carbon layer 120 can be replaced by a graphite layer. The carbon layer 120 can be formed by using a sputtering method or by coating the surface of the metal plate 110 with carbon powder, and a graphite layer can be formed by coating the surface of the metal plate 110 with graphite powder.

Hereinafter, a method of forming the carbon layer 120 (or a graphite layer) will be described in greater detail with reference to FIG. 7.

Figure 7:
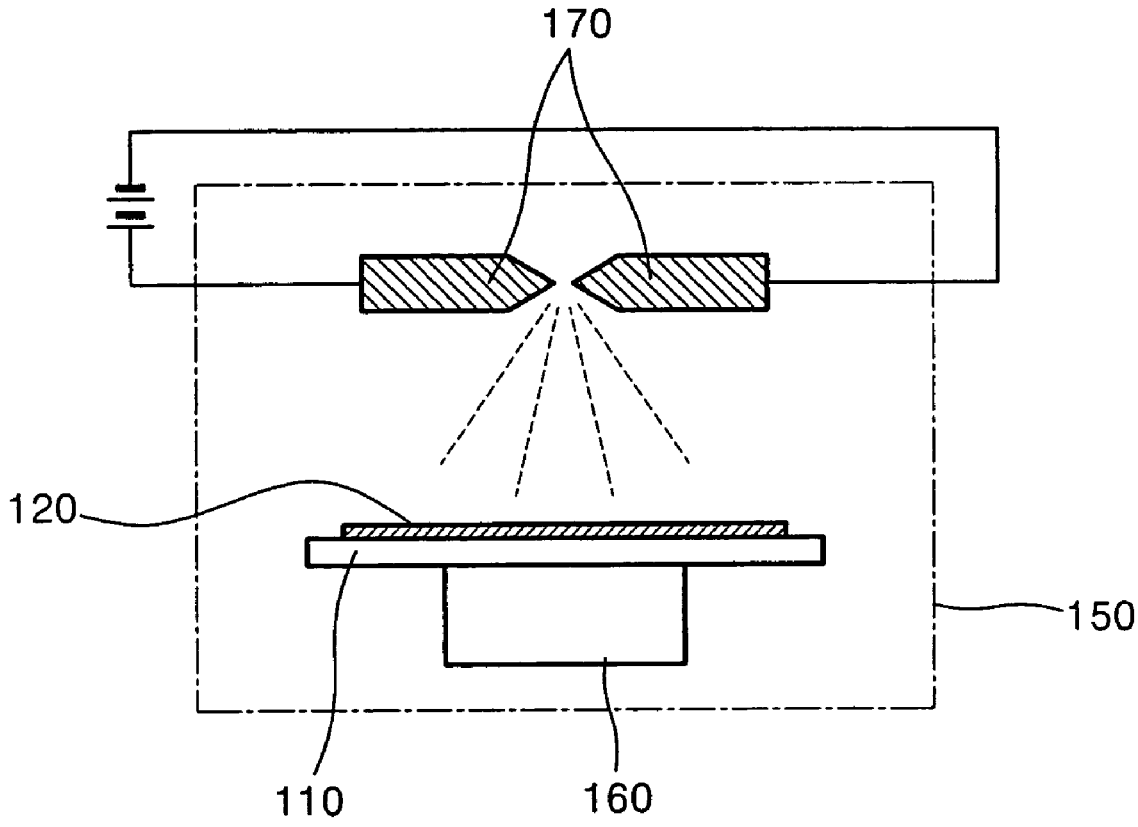
FIG. 7 is a diagram illustrating a sputtering method for depositing a carbon layer on a metal plate.

FIG. 7 is a diagram illustrating a sputtering method for depositing the carbon layer 120 on the metal plate 110. Referring to FIG. 7, the metal plate 110 is placed on a receptor 160 in a vacuum chamber 150. The carbon layer 120 is thinly formed on the metal plate 110 to have a thickness of several or dozens of micrometers by using a sputtering method. More specifically, two high-purity carbon rods 170 are arc-discharged by applying a high voltage to the high-purity carbon rods 170 such that carbon atoms are emitted from the high-purity carbon rods 170. Thereafter, the carbon atoms are deposited on the metal plate 110 using a sputtering method, thus forming the carbon layer 120.

The carbon layer 120 can be formed by coating the surface of the metal plate 110 with carbon powder. More specifically, a carbon paste is formed by mixing high-purity carbon powder with a solvent. Here, the solvent is preferably a volatile solvent. The carbon paste is spread over the metal plate 110 to have a predetermined thickness and is then dried at room temperature or higher, thereby forming the carbon layer 120 on the metal plate 110. During the drying of the carbon paste, the solvent vaporizes, so a high-purity carbon layer 120 can be formed on the metal plate 110.

Likewise, a graphite layer can be formed on the metal plate 110 instead of the carbon layer 120. More specifically, a graphite paste is formed by mixing high-purity graphite powder with a solvent. The graphite paste is spread over the metal plate 110 to have a predetermined thickness and is then dried at room temperature or higher, thereby forming the graphite layer on the metal plate 110.

As described above, in the present invention, the carbon layer (or the graphite layer) is formed by using a sputtering method or by coating the metal plate 110 with carbon powder (or graphite powder). Therefore, the possibility of silicon oil having an influence on a mass spectrum of a sample can be completely ruled out since there is no need to use the silicon oil in the present invention, unlike in the prior art.

Since the metal plate 110 is reusable, it is possible to prepare the sample holder 100 by forming the carbon layer 120 (or the graphite layer) on the metal plate 110 whenever mass spectrum analysis is carried out. Therefore, a process of manufacturing the sample holder 100 can be simplified compared to a process of manufacturing a sample holder including a silicon plate.

As described above, the sample 130 is loaded onto the carbon layer 120 (or the graphite layer) deposited on the metal plate 110 in the shape of multiple spots, as shown in FIGS. 5 and 6. The sample holder 100 with the sample 130 loaded thereonto is placed in a chamber (not shown) of a mass spectrometer. Thereafter, ultra violet rays or infrared laser beams are applied to the sample 130 loaded onto the carbon layer 120. Then, the carbon layer 120 absorbs energy of the laser beams applied thereto and thus is desorbed from the metal plate 110. At this moment, the sample 130 is also desorbed from the metal plate 110 together with the carbon layer 120. Then, the sample 130 is ionized by $Na^+$ and $K^+$ ions contained in the carbon layer 120. Ions of the sample 130 are accelerated by an electric field formed by a grid (not shown) and then travel by a predetermined distance until they arrive at a detector 140. Time of flight (TOF) of the sample ions can be measured by the detector 140, and masses of the sample ions can be analyzed based on the TOF of each of the sample ions.

As described above, in the sample holder 100, the sample 130 is loaded onto the carbon layer 120 or a graphite layer. When the carbon layer 120 or the graphite layer absorbs ultra violet rays or infrared rays, it desorbs itself from the metal plate 110 and ionizes the sample 130. Accordingly, in the present embodiment, unlike in the prior art, there is no need to use a matrix to desorb and ionize the sample 130. Therefore, it is possible to rule out the possibility of the matrix having an undesirable influence on the mass spectrum of the sample 130. In addition, it is possible to prevent the metal plate 110 from being eroded by the matrix, such as organic acid, causing an uneven surface.

Figure 8A:
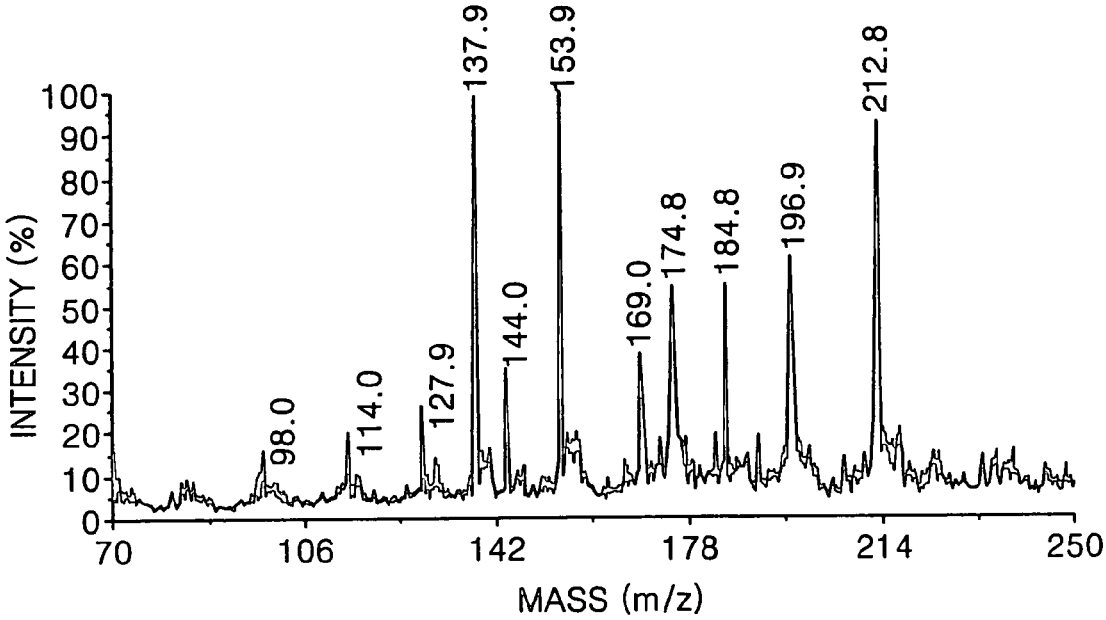
FIG. 8A is a diagram illustrating a mass spectrum of a sample with a low molecular weight, which is obtained by using a sample holder for laser desorption/ionization mass spectrometry, according to a preferred embodiment of the present invention.

FIG. 8A illustrates a mass spectrum of a low molecular weight material, which is obtained by using a sample holder for laser desorption/ionization mass spectrometry, according to a preferred embodiment of the present invention. Here, the low molecular weight material is the same material that was used in the conventional mass spectrometry with reference to FIG. 2A.

Figure 2A:
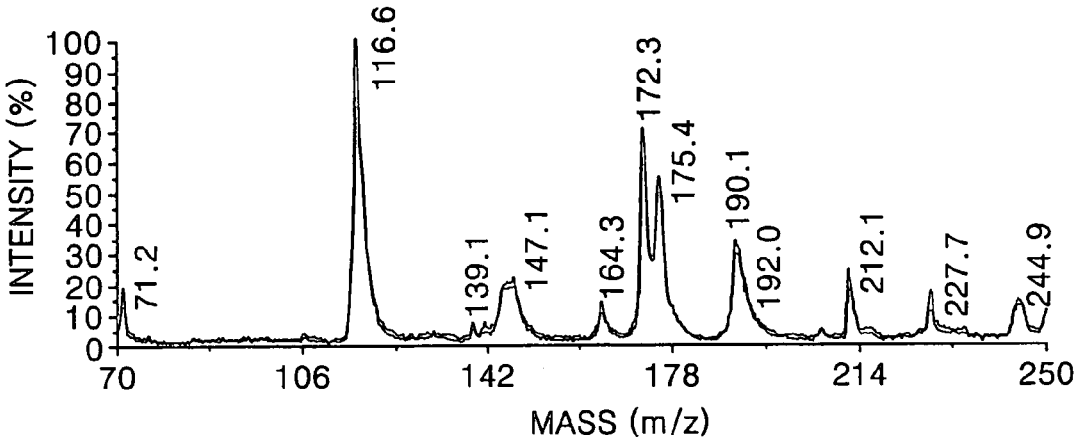
FIG. 2A (PRIOR ART)
FIG. 2A is a diagram illustrating a mass spectrum of a sample, which is obtained by using the conventional MALDI mass spectrometer.

Referring to FIG. 8A, there are many clear peaks representing masses of sample ions compared to FIG. 2A. Therefore, FIG. 8A shows that it is possible to easily and precisely analyze a mass spectrum of a sample with a low molecular weight of 500 Da or lower without using a matrix and by using the sample holder for laser desorption/ionization mass spectrometry, according to the preferred embodiment of the present invention.

In addition, since a carbon layer or a graphite layer of the sample holder contains $Na^+$ and $K^+$ ions, it is possible to ionize a polymer and measure the mass of the polymer without using an ionization additive, such as salt.

Figure 8B:
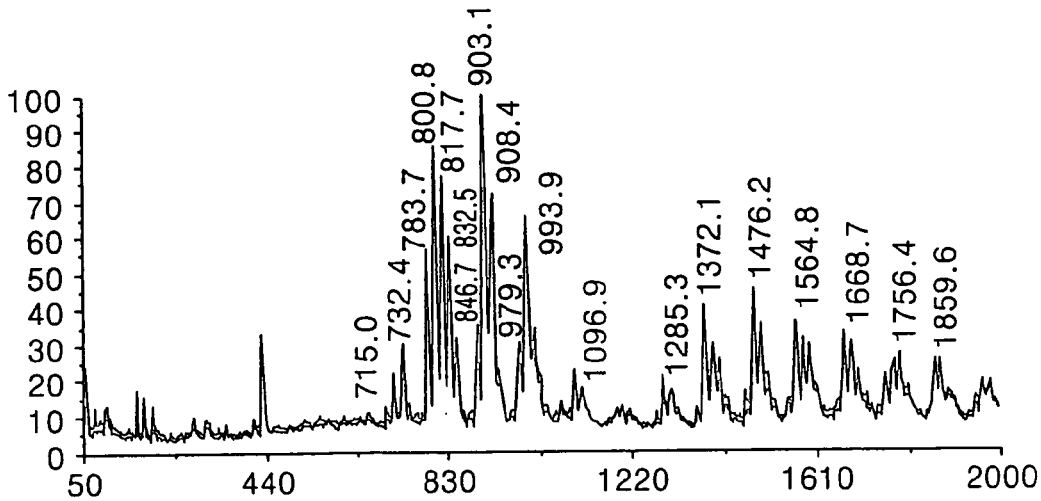
FIG. 8B is a diagram illustrating a mass spectrum of a polymer, which is obtained by using the sample holder for laser desorption/ionization mass spectrometry, according to the preferred embodiment of the present invention.

FIG. 8B illustrates a mass spectrum of a polymer, which is obtained by using the sample holder for laser desorption/ionization mass spectrometry, according to the preferred embodiment of the present invention. Here, the polymer is the same material that was used in the conventional mass spectrometry regarding FIG. 2B.

Figure 2B:
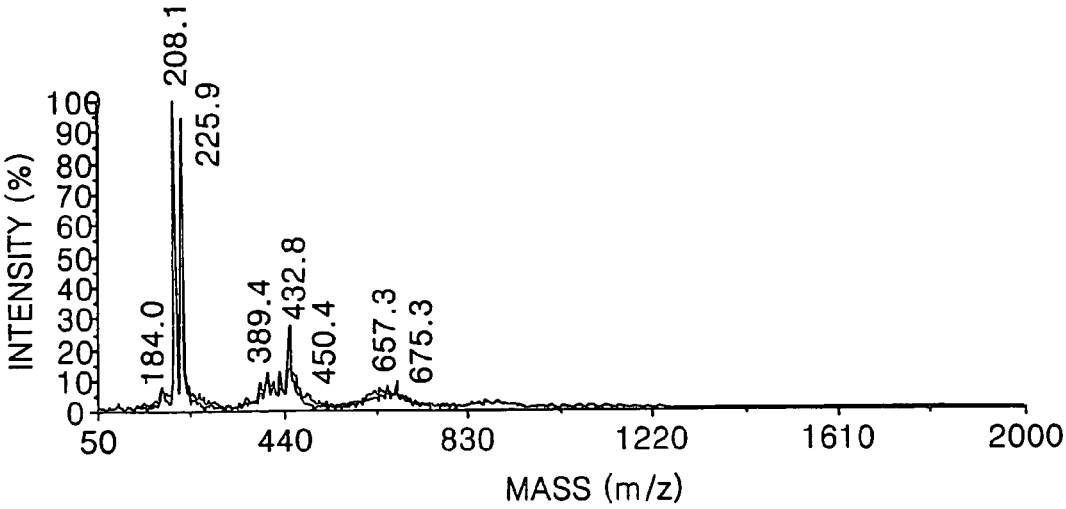
FIG. 2B (PRIOR ART)
FIG. 2B is a diagram illustrating a mass spectrum of a polymer, which is obtained by using the conventional MALDI mass spectrometer.
Figure 3:
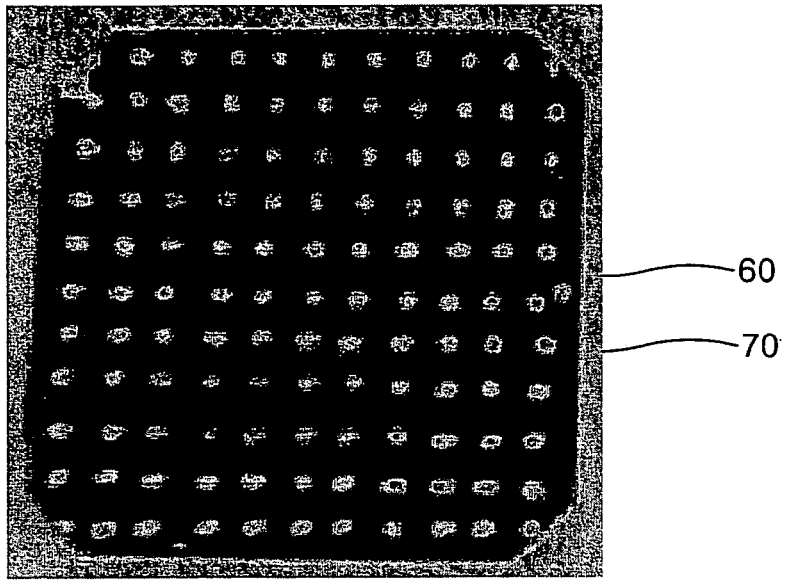
FIG. 3 (PRIOR ART)
FIG. 3 is a photograph of a conventional graphite sample holder.
Figure 4:
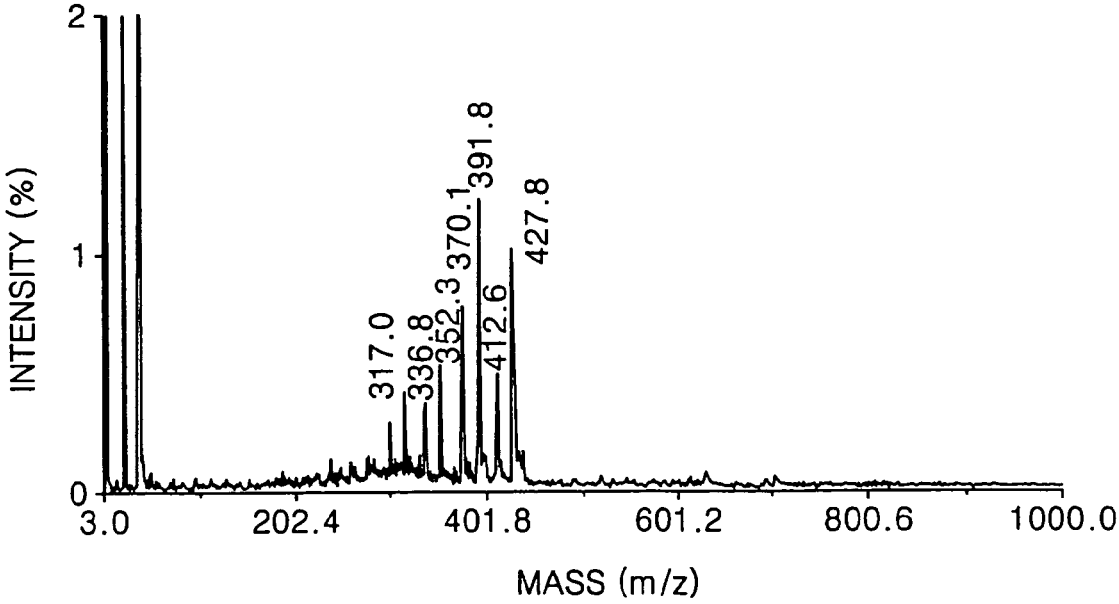
FIG. 4 (PRIOR ART)
FIG. 4 is a diagram illustrating a mass spectrum obtained from the conventional graphite sample holder.

Referring to FIG. 8B, many clear peaks representing masses of polymer ions are detected, compared to FIG. 2B.

As described above, the carbon layer or the graphite layer of the sample holder according to the preferred embodiment of the present invention is formed by using a sputtering method or by coating a metal plate with carbon powder or graphite powder without using silicon oil. Thus, the possibility of the silicon oil to have an undesirable influence on the mass spectrum of the polymer can be ruled out. In addition, it is possible to precisely analyze a mass spectrum of a sample with a low molecular weight of about 300–400 Da.

Figure 8C:
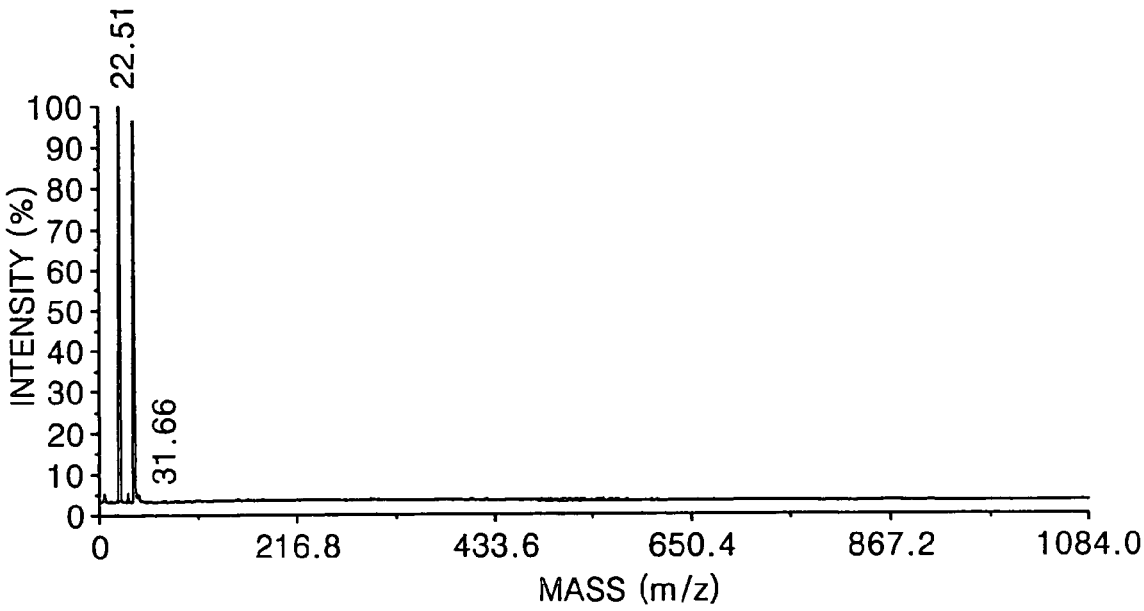
FIG. 8C is a diagram illustrating a mass spectrum of a carbon layer of the sample holder for laser desorption/ionization mass spectrometry, according to the preferred embodiment of the present invention.

FIG. 8C illustrates a mass spectrum of the carbon layer of the sample holder according to the preferred embodiment of the present invention. Referring to FIG. 8C, no peaks caused by silicon oil are detected in a mass range of 300–400 m/z. Instead, peaks representing masses of $Na^+$ and $K^+$ ions are only detected in a mass range of 20–30 m/z.

As described above, the present invention can provide the following advantages.

First, since the sample holder of the present invention includes a carbon or graphite layer formed on a metal plate, it is possible to obtain a mass spectrum of a sample without any possibilities of a matrix having an influence on the mass spectrum of the sample. In addition, since the carbon or graphite layer is formed by using a sputtering method or by coating the metal surface with carbon powder or graphite powder, the possibility of silicon oil affecting the mass spectrum of the sample can also be ruled out. Therefore, it is possible to easily and precisely analyze a mass spectrum of not only a polymer but also a low molecular weight material with a molecular weight of 500 Da or lower.

Second, since the carbon or graphite layer contains $Na^+$ and $K^+$ ions, it is possible to ionize a polymer and measure the mass of the polymer without adding an ionization additive, such as salt, to the polymer.

Third, since the metal plate of the sample holder of the present invention is reusable, it is possible to simplify a process of manufacturing the sample holder by thinly forming the carbon or graphite layer on the metal plate whenever a mass spectrum analysis is carried out.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A sample holder for laser desorption/ionization mass spectrometry, which loads a sample to be analyzed using laser desorption/ionization mass spectrometry, the sample holder comprising:

a metal plate; and a thin layer, which is formed on the metal plate and into which the sample is loaded, wherein the thin layer is formed of a carbon-based material.

2. The sample holder of claim 1, wherein the thin layer is formed of carbon.

3. The sample holder of claim 1, wherein the thin layer is formed of graphite.

4. The sample holder of claim 1, wherein the thin layer is formed on the metal layer to have a thickness of several or dozens of micrometers.

5. The sample holder of claim 1, wherein the metal plate is formed of one of stainless steel and gold-coated steel.

6. A method of manufacturing a sample holder for laser desorption/ionization mass spectrometry, the sample holder loading a sample to be analyzed using laser desorption/ionization mass spectrometry, the method comprising:

preparing a metal plate; and depositing a carbon layer on the metal plate through sputtering.

7. The method of claim 6, wherein the carbon layer is deposited on the metal plate by arc-discharging a carbon rod and sputtering carbon atoms onto the metal plate.

8. The method of claim 6, wherein the carbon layer is formed on the metal plate to have a thickness of several or dozens of micrometers.

9. A method of manufacturing a sample holder for laser desorption/ionization mass spectrometry, the sample holder loading a sample to be analyzed using laser desorption/ionization mass spectrometry, the method comprising:

forming a carbon paste by mixing carbon powder with a solvent, then coating a surface of the metal plate with the carbon paste; and forming a carbon layer on the metal plate by drying the carbon paste.

10. The method of claim 9, wherein the solvent is a volatile solvent and vaporizes when drying the carbon paste.

11. The method of claim 9, wherein the carbon layer is formed on the metal plate to have a thickness of several or dozens of micrometers.

12. The method of claim 9, wherein the metal plate is manufactured by cutting a stainless steel plate with a predetermined thickness into pieces.

13. A method of manufacturing a sample holder for laser desorption/ionization mass spectrometry, the sample holder loading a sample to be analyzed using laser desorption/ionization mass spectrometry, the method comprising:

forming a graphite paste by mixing graphite powder with a solvent, then coating a surface of the metal plate with the graphite paste; and forming a graphite layer on the metal plate by drying the graphite paste.

14. The method of claim 13, wherein the solvent is a volatile solvent and vaporizes when drying the graphite paste.

15. The method of claim 13, wherein the graphite layer is formed on the metal plate to have a thickness of several or dozens of micrometers.

16. The method of claim 13, wherein the metal plate is manufactured by cutting a stainless steel plate with a predetermined thickness into pieces.

* * * * *